US005575172A

United States Patent [19]

Bonny et al.

[11] Patent Number: 5,575,172

[45] Date of Patent: Nov. 19, 1996

[54] DEVICE FOR PRODUCING HOLLOW BODIES ACCORDING TO AN INTERNAL HIGH PRESSURE METAL FORMING PROCESS

[75] Inventors: Pierre Bonny; Thoralf Nehls, both of Hamburg, Germany

[73] Assignee: Mercedes-Benz, Stuttgart, Germany

[21] Appl. No.: 534,463

[22] Filed: Sep. 27, 1995

[30] Foreign Application Priority Data

Sep. 27, 1994 [DE] Germany ..... 44 34 441.4

[51] Int. Cl.[6] ..... B21D 22/00; B21D 39/08

[52] U.S. Cl. ..... 72/357; 72/358; 72/353.2; 72/354.6; 72/57

[58] Field of Search ..... 72/58, 57, 357, 72/358, 359, 353.2, 354.6, 352

[56] References Cited

U.S. PATENT DOCUMENTS

| | | | |
|---|---|---|---|
| 4,106,322 | 8/1978 | Moshnin et al. | 72/358 |
| 4,638,538 | 1/1987 | Kohama et al. | 72/357 |

FOREIGN PATENT DOCUMENTS

| | | |
|---|---|---|
| 4320236C1 | 3/1984 | Germany . |
| 4103078C2 | 8/1992 | Germany . |

*Primary Examiner*—Lowell A. Larson
*Assistant Examiner*—Rodney Butler
*Attorney, Agent, or Firm*—Evenson, McKeown, Edwards & Lenahan, P.L.L.C.

[57] ABSTRACT

A device for producing a hollow body according to an internal high pressure metal forming process has a tool which is divided along a mold joint into a stationary tool part and a liftable tool part. The tool has an impression for receiving a tube-shaped blank. A press opens and closes the tool. An axially movable slide is attached to an open end of the blank, through which a pressure medium is introduced into the blank. A hydraulic working cylinder which is angularly and vertically adjustable on a support member has a piston rod which holds the slide and which displaces the slide axially. A pair of pull rods connect the tool and the working cylinder and are arranged on opposite sides of the piston rod at the same level as the piston rod, each pull rod extending into the end-side portion of the mold joint and being releasably anchored to each of the stationary tool part and the liftable tool part in a form-locking manner in corresponding recesses along the mold joint. The recesses are configured such that after a working cycle the liftable tool part can be lifted away from the pull rod in a vertical direction without resistance. In another embodiment the pull rods are releasably anchored to a holding wall in a form-locking manner in corresponding recesses, the holding wall being stationarily fastened to the stationary tool part.

34 Claims, 3 Drawing Sheets

DEVICE FOR PRODUCING HOLLOW BODIES ACCORDING TO AN INTERNAL HIGH PRESSURE METAL FORMING PROCESS

BACKGROUND AND SUMMARY OF THE INVENTION

This device relates to a device for producing hollow bodies according to an internal high pressure metal forming process (IHU Process), and more particularly to such a device having an IHU-tool which is divided along a mold joint, the tool having an impression for receiving a tube-shaped blank, a press for opening and closing the IHU-tool, axially movable slides which are attached to an open end of the blank, working cylinders having piston rods to displace the slides axially, and a pair of pull rods which are assigned to the working cylinders to receive the reaction force between the IHU-tool and the working cylinder.

In the case of the device for producing hollow bodies according to the internal high pressure metal forming process (IHU Process) according to German Patent Document DE 41 03 078 C1, although the two pull rods of a pair are arranged at the same height with respect to one another and—viewed in the moving direction of the press toward the stationary tool part—on the right and left next to the piston rod of the working cylinder, they extend in a vertically offset manner with respect to the piston rod, that is, lower than the piston rod, specifically along the top side of the base plate carrying the shape-determining die and the working cylinders. In the case of the known device, by way of the above-mentioned slides, only the blank is closed on the face and the pressure medium is supplied, but an axial upsetting of the blank within the impression is not carried out. For this reason, the slides must only be pressed on by means of an axial force corresponding to the metal forming pressure and the cross-sectional surface of the blank.

A disadvantage in the case of the known device is the moment-loaded and non-exchangeable linking of the working cylinders to the pertaining shape-determining die. Because of the moment load of the pull rods during the pulling effect, for preventing unacceptably high tilting of the working cylinders, the pull rods and the working cylinders must be disposed along their whole length flatly on the above-mentioned base plate which, in turn, is supported on the press bed. Thus, the base plate and the press bed contribute to the relieving of moments of the linking of the working cylinders. However, they can only do so if the IHU-tool carrying the impression, including the working cylinders and their pull rod linking to the IHU-tool, each form a closed subassembly—as explicitly indicated—which, in its total course, rests flatly on the base plate and, after its adjustment, is fixedly screwed to it and which, in the case of a tool change, has to be exchanged as a whole. In addition, only horizontal positions of the working cylinders can be permitted in the different tools which are used alternately.

It is an object of the present invention to improve an IHU-tool in such a manner that arbitrary spatial positions of the working cylinders are possible and that, in the case of a tool change, only the die carrying the impression—in this case, called IHU-tool—has to be exchanged while the working cylinders remain in the device for producing hollow bodies or that the working cylinder/cylinders may be used on different dies.

These and other objects have been achieved according to the present invention by providing a device for producing a hollow body according to an internal high pressure metal forming process comprising a tool which is divided along a mold joint into a stationary tool part and a liftable tool part, the tool having an impression for receiving a tube-shaped blank, an end-side impression being assigned to an end of the blank, respectively, and being arranged approximately parallel to and centrally with respect to an end-side portion of the mold joint; a press which is movable in a direction transverse to the mold joint to open and close the tool; an axially movable slide which is arranged concentrically with respect to the end-side impression, respectively, and which is sealingly attached to an open end of the blank, a pressure medium being introduced into the blank via at least one slide; a hydraulic working cylinder which is arranged with a common axis as the end-side impression, respectively, and having a piston rod which holds the slide and which displaces the slide axially, the working cylinder being angularly and vertically adjustable on a support member; and a pair of pull rods which is assigned to the working cylinder, connecting the tool and the working cylinder with tensile strength in parallel to the common axis in order to receive a reaction force between the tool and the working cylinder, the pull rods of the pair being arranged on opposite sides of the piston rod at the same level as the piston rod, each pull rod extending into the end-side portion of the mold joint and being releasably anchored to each of the stationary tool part and the liftable tool part in a form-locking manner in corresponding recesses along the mold joint, the recesses configured such that after a working cycle the liftable tool part can be lifted away from the pull rod in a vertical direction without resistance.

The objects of the invention are also achieved according to another embodiment of the present invention in which each pull rod is releasably anchored to a holding wall in a form-locking manner in corresponding recesses, the holding wall being stationarily fastened to the stationary tool part and projecting beyond the mold joint in a direction toward the liftable tool part by at least half the diameter of the pull rod.

Because of the central arrangement and the linking of the pull rods in the area of the mold joints, the pull rods are relieved from moments during a tensile force load. This relieving of moments, in turn, permits the constructional detachment of the working cylinder from the bearing base plate so that different, particularly sloped spatial positions of the working cylinders may be permitted. The constructional detachment of the working cylinders from the base plate also permits the exchangeable coupling and the universal use of the working cylinders on different IHU-tools which are used alternately so that now, in the case of a retooling of the device to the production of a different hollow body, only the die parts carrying the impression have to be changed and the working cylinders may remain in the device. The number of parts which have to be exchanged during a retooling can therefore be reduced considerably.

Although it is known from German Patent Document DE 43 20 236 C1 to hold, in the case of devices for producing hollow bodies according to the IHU-process, the metal forming slides so that they can be adjusted in space relative to one another with respect to their axial position and with respect to their point of application, a displacement construction is shown for this purpose which has a high-expenditure design, is flexible under a load and is not satisfactory in practice.

These and other objects, features and advantages of the present invention will become more readily apparent from the following detailed description when taken in conjunction with the accompanying drawings.

DETAILED DESCRIPTION OF THE DRAWINGS

Figure 1:
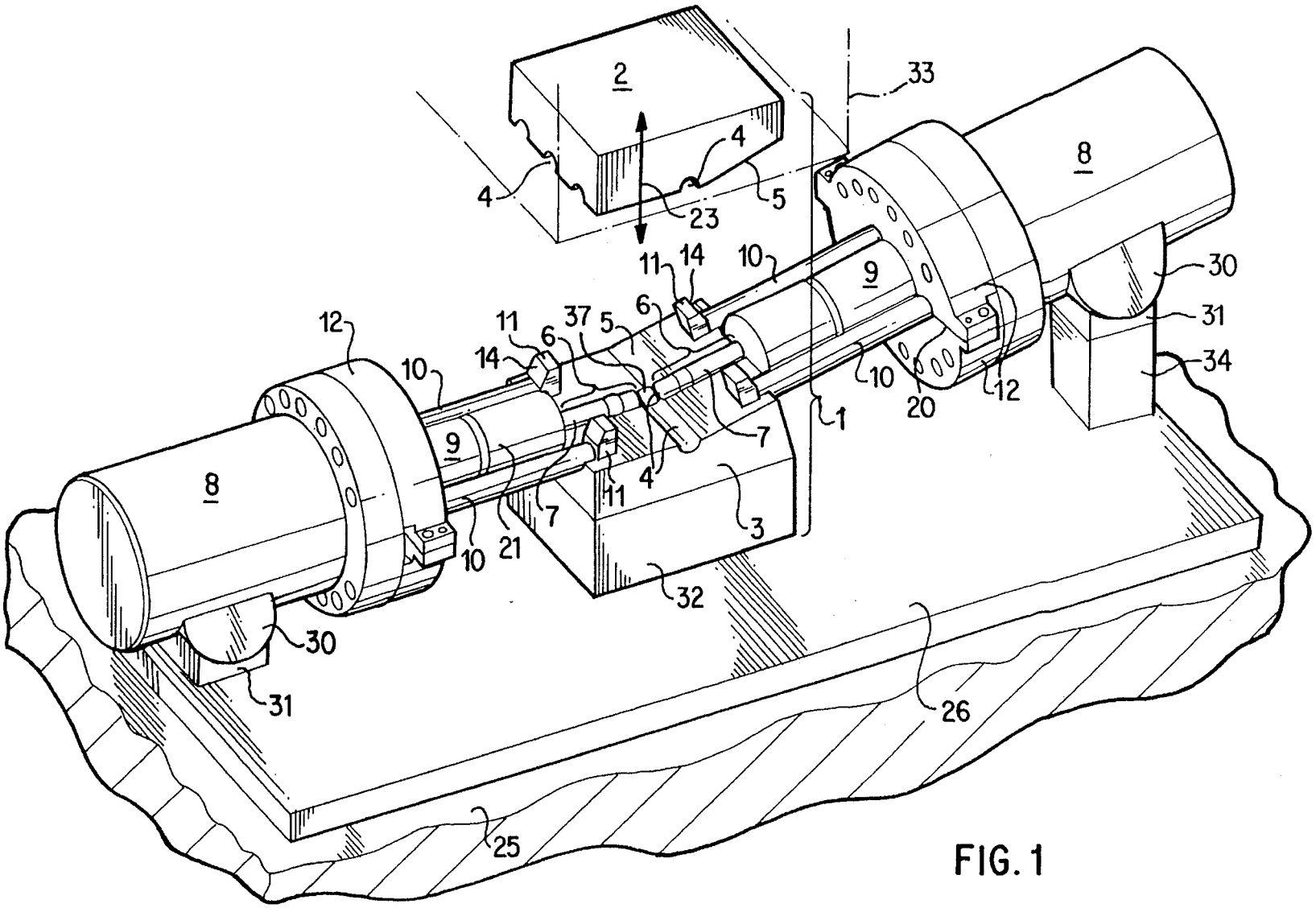
FIG. 1 is a perspective, partly exploded, view of a first preferred embodiment of a device for producing hollow bodies according to the internal high pressure metal deforming process with an approximately horizontally disposed working cylinder which is arranged in a sloped manner and is coupled to the IHU-tool by way of pull rod pairs, the pull rods being anchored by way of hammer heads in recesses in both opposite mold joints.

In the case of the device for producing hollow bodies according to the internal high pressure metal forming process (IHU-process) illustrated in FIG. 1, a press required for this purpose is outlined only by a press bed 25 and by a liftable press part 33. The press is used, among other things, for the opening and closing of the IHU-tool described in detail below and for holding together this tool by means which withstand the metal forming forces. On the press bed, a base plate 26 is fastened on which the stationary parts of the device for carrying out the IHU-process are arranged, whereas the movable press part 22 receives the liftable tool part. An important aspect in this connection is the IHU-tool 1 which is divided into a stationary tool part 3 and into a movable tool part 2. Both tool parts are separated along mold joints 5 and each carry an impression 4. The impression determines the desired final form of the hollow part. A tube-shaped blank 37 is placed in the impression. The impression, which is assigned to the ends of the blank—in the following abbreviated to "end-side impression" 6—is disposed approximately in parallel and centrically with respect to the corresponding end side portions of the mold joints of the IHU-tool. Concentrically with respect to the end-side impressions of the IHU-tool 1, axially movable slides 7 are arranged of which one respectively can be joined in a sealing manner to an open front end of the blank 37. By way of at least one of the slides, a pressure medium can be introduced into the blank. The slides, in turn, are held and guided with the insertion of adapters 21 on the piston rods 9 of working cylinders 8 which can be acted upon hydraulically. It is therefore important that the working cylinders are held coaxially with respect to the end-side impressions 6 of the IHU-tool. Since considerable pressures of a magnitude of several 1,000 bar act in the interior of the blanks and since the cross-sectional surfaces of the workpieces may also have a considerable size, considerable forces of a magnitude of several 100 kN must be maintained just for maintaining a sealing contact of the slide on the front face of the blank. If, in addition, blank material must also be pushed to the center of the portion to be formed into the IHU-tool, the axial forces acting upon the workpiece by way of the slides will even be higher. In order to be able to absorb the cylinder-side reaction forces in a short-circuited flux of force in a manner which is as simple as possible, one pair of pull rods 10 respectively is provided for each working cylinder 8, which pull rods extend between the IHU-tool 1 and the working cylinder 8, are aligned in parallel to the cylinder axis and are fastened to the tool and the cylinder with tensile strength. One pull rod 8 respectively extends on the right and on the left next to the piston rod 9.

The pull rods are arranged with their center lines in each case at the same height as the end-side impressions 6, and thus at the same height as the piston rods 9 in order to relieve the pull rods from the moment load during the tensile load effect. In order to be able to link the pull rods free of moments, in the case of this relative position of the pull rods to the mold joints 5, also to the IHU-tool, the two pull rods 10 of one pair each extend into the end-side area of the mold joints 5 of the stationary 3 as well as of the liftable tool part 2 and are anchored there with the two tool parts 2 and 3 in a form-locking manner against a pulling-out in corresponding recesses 15 and 16 which are worked into the mold joints. This is at least provided in the case of the embodiment illustrated in FIG. 1.

The anchoring of the pull rods 10 with the liftable part 2 of the IHU-tool 1 is constructed in such a manner that, during each working cycle, the corresponding recess 15 (FIG. 4), by means of the lifting movement, can be easily detached from the pull rods and the corresponding mold joints or can be closed again by means of the closing movement. This will be discussed in detail further below. In addition, the releasable anchoring of the pull rods on the part of the tool, in the case of a plurality of alternately used IHU-tools 1 and 1", is constructed to be corresponding and exchangeable in such a manner that, in the case of all IHU-tools, the pull rods can be anchored in an exchangeable fashion, and thus, when a retooling of the device to another workpiece becomes necessary, only the dies carrying the impression, that is, IHU-tool 1 or 1", need to be exchanged, whereas the working cylinders 8 and the pull rods 10 may remain in the device. This means that it is possible that the working cylinder/cylinders may be used on different dies.

Furthermore, the pull rods 10 are anchored in the stationary tool part so that they are secure with respect to tilting in such a manner—which, however, is not shown here—that the dead weight of the working cylinders 8 cannot lift the pull rods out of the lower anchoring. For example, this may be implemented in that the heads on the pull rod ends are secured and fixed by transversely extending screws and/or by a corresponding accuracy of the fit. In the embodiments illustrated in the drawings, the pull rods 10 are anchored in the IHU-tools by means of a hammer head 11. This hammer head may be connected in a detachable manner with the pull rod, for example, by a thread, or may be connected in an undetachable manner, and may specifically form a monolithic unit with it, which is usually the case with respect to forged-on heads of screws. The question of whether to use a detachable or a forged-on hammer head also depends on the type of the linking of the pull rods on the side of the working cylinder. In order to permit differently sloped mounting position of a working cylinder or of the pull rods 10 in relation to the vertical moving direction 23 of the liftable tool part when different, alternately used IHU-tools are used, special design characteristics must be provided on the tool-side anchoring of the pull rods, which will be explained in detail in the following in connection with FIG. 4.

Figure 4:
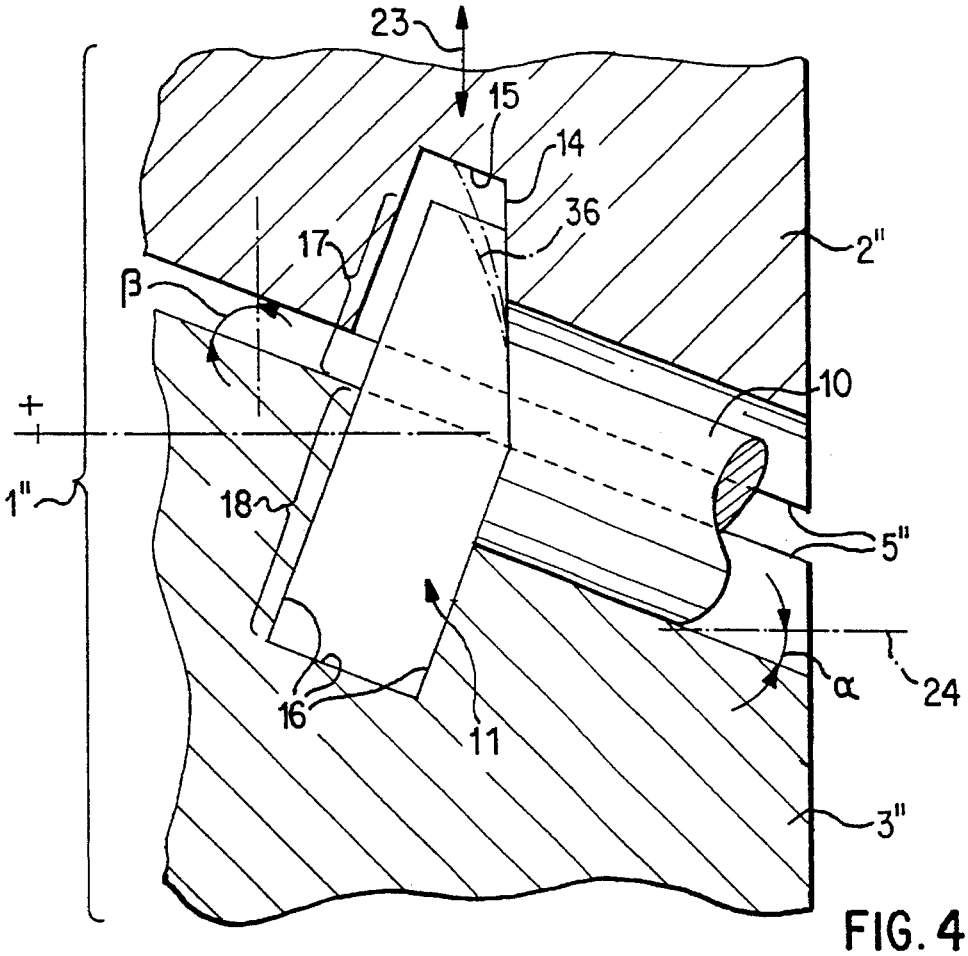
FIG. 4 is a cross-sectional view of the anchoring of a pull rod according to the embodiment of FIG. 1 represented in the example of a pull rod arranged in a sloped manner at a maximal angle.

In the case of the embodiment of an IHU-tool 1" shown in FIG. 4 in section, the pull rod 10 is sloped at an angle $\alpha$ with respect to the horizontal line 24, in which case it should be assumed for the shown embodiment that there the present angle α, among all alternatively used IHU-tools with the downwardly directed slope of the pull rod 10 has the largest angle. In the case of this embodiment, the hammer head 11 is to be forged on and is subsequently to be cut to a precise fit. As a result, a downwardly pointing section 18 of the hammer head can be inserted into the corresponding recess 16 in the stationary tool part 3". The lower hammer head 18 is accommodated without play and secure from tilting in the corresponding recess. As a result, the hammer head is held free from play in the lower tool part 3". The upper section 17 of the hammer head also extends into a corresponding recess 15 of the liftable tool part 2". The contact surface 14 of the hammer head, which transmits pressure when the pull rod 10 is under tensile load and which points in the direction of the working cylinder 8, is slanted in a straight line in the vertical direction 23 like the corresponding wall of the recess 15. The angle β of this slanting between the pressure-transmitting surface 14 and the mold joint 5" corresponds to the above-mentioned angle α plus 90°. The contact surface 36 of the hammer head may also extend as a curved surface from the side of the pull rod 10 facing the working cylinder 8 toward the side of the pull rod 10 facing the tool, as shown by the dash-dot lines in FIG. 4. In this case, the curved surface 36 is constructed such that the tangent at the point of intersection with the pull rod 10 extends in the vertical direction 23 and forms the angle β with the mold joint 5". Because of this angular relationship, it is ensured that, in the case of all angular positions, the recess 15 can be adapted free from undercutting and from play to the upper hammer head section 17 and can easily be slid in the vertical moving direction 23 onto the upper hammer head section.

So that—depending on the type of the workpiece to be produced and correspondingly depending on the type of the respective IHU-tool 1 or 1"—the working cylinders 8 can be coupled to the IHU-tool, it is advantageous for the working cylinders 8 to be arranged at a distance a from the base plate 26 carrying the IHU-tool or from the press bed 25. In order to ensure that such a distance of the working cylinders can be implemented in the downward direction, the stationary tool part 3 of the IHU-tool may be supported in the lifting direction by exchangeable adapting pieces 32.

It has been mentioned that the pull rods 10 are held so that they are secure with respect to tilting in the stationary tool part 3 or 3" and, if necessary, are screwed to it. Since the pull rods 10 can be dimensioned to be sufficiently strong, they would also be capable of taking up the dead weight of the working cylinder 8 so that the latter is held virtually in a floating manner from the stationary tool part 3. Since, however, because of their large dimensioning, the working cylinders have a considerable own weight and may correspondingly load the pull rods with respect to a bending, and since such a bending load is disadvantageous for a precise working of the working cylinders and the slides 7 guided by them, it is advantageous for the own weight of the working cylinders 8 to be supported by a supporting structure. In order to be able to adapt this supporting structure to the respective circumstances of the alternately used IHU-tools, the supporting structure is designed to be adaptable in its height as well as in the angular position. In the embodiment of a vertically changeable and angularly adaptable supporting structure illustrated in FIG. 1, a supporting roller 30 is provided which is fixedly connected with the circumference of the working cylinders and which is placed in a roller joint 31 of a corresponding shape. As a result, the working cylinder 8 can be supported in any swivel position. For adapting the supporting structure to the height, adapting pieces 34 having differing heights can be pushed under the roller joint 31.

Naturally, the pull rods 10 must also be anchored with tensile strength on the side of the working cylinder 8, although here the anchoring is easier to implement than on the part of the IHU-tool because there they do not have to be designed to be exchangeable and because they are not disposed in a movable joint. In the two illustrated embodiments, the two pull rods are anchored on the working cylinder 8 in a holding plate 12 which is screwed to the piston-rod-side face of the working cylinder. The pull rods 10 are anchored in the holding plate 12 by one head 19 respectively which, in each case, rests in a recess against the screw-on side of the holding plate, in which case the pull rods 10 penetrate through an opening in the holding plate in the direction of the IHU-tool. The pull rods may be screwed into the holding plate by means of an axially highly loadable thread or may be anchored in the holding plate by means of a bayonet-type turning locking device. This is particularly advisable when the holding plate—as provided in the embodiment according to FIG. 2—is constructed in one piece. However, in the embodiment illustrated in FIG. 1, the holding plate 12 is constructed in two parts, in which case the parting joint 20 of the holding plate extends diametrically through the two passage openings for the pull rods 10 and through the interposed passage opening for the piston rod 9 of the working cylinder. On both ends of the pull rods, that is, on the tool-side and on the cylinder-side end of the pull rods, the respective heads 11 and 19 may be connected in a releasable manner with the pull rods; that is, in particular, the two heads can be forged on.

Figure 2:
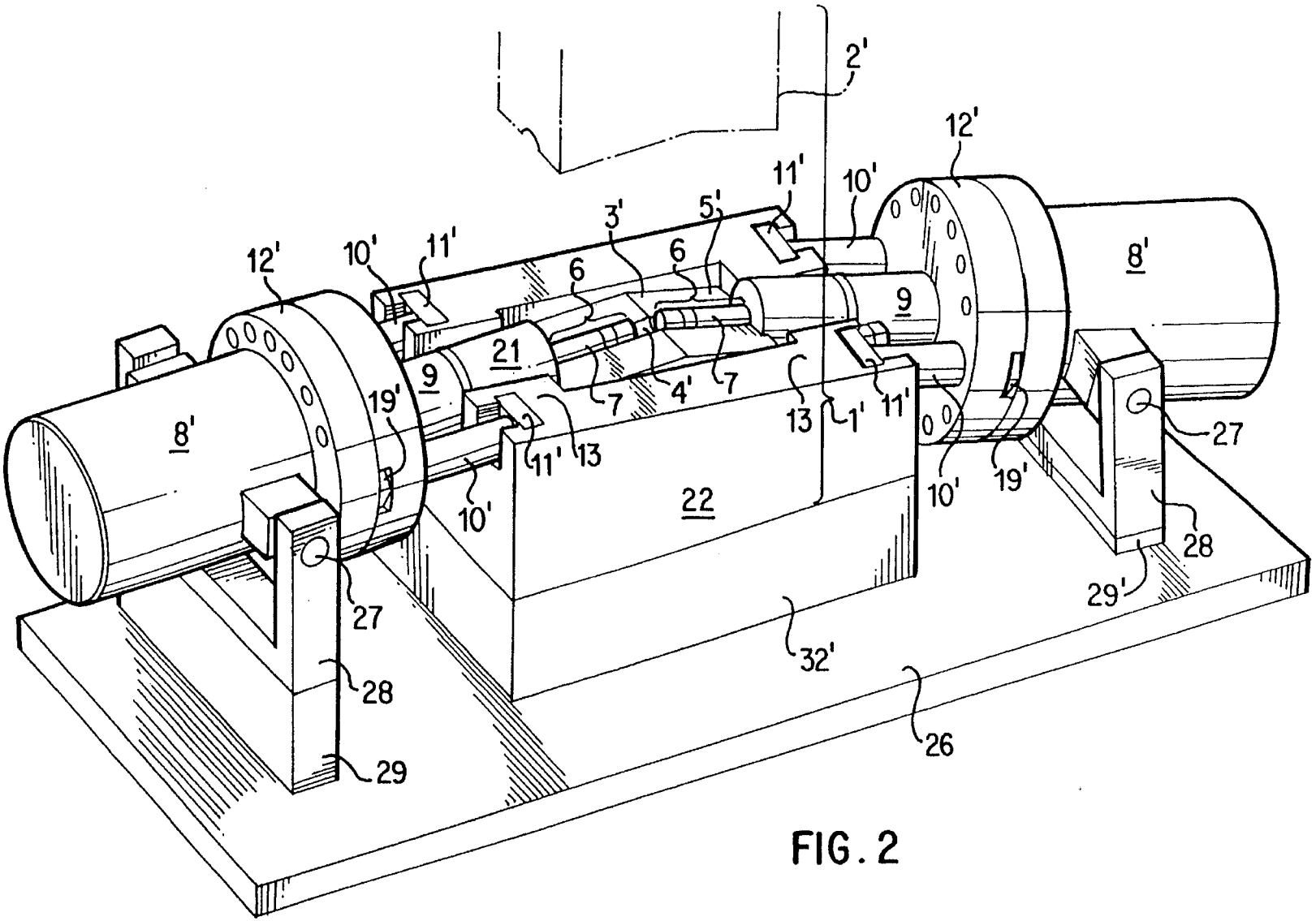
FIG. 2 is a perspective view of a second preferred embodiment of a device similar to that of FIG. 1, in which one of the working cylinders is arranged in a descending manner and in which the pull rod pairs are anchored in a holding wall assigned to the lower tool part.
Figure 3:
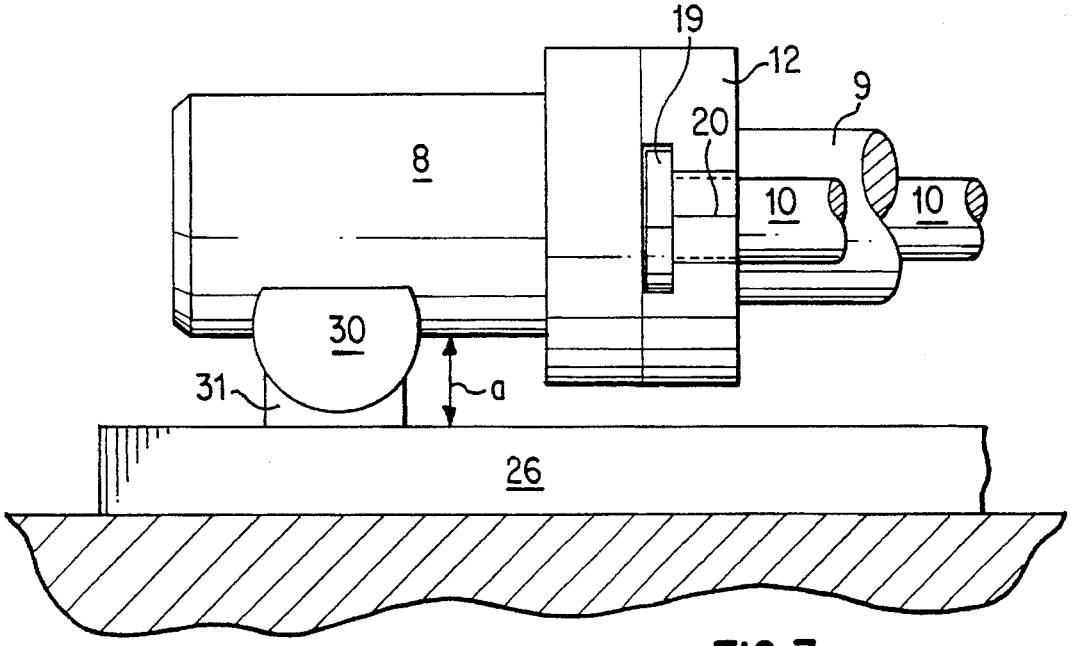
FIG. 3 is a lateral view of the support of the working cylinder which is arranged on the left in FIG. 1.

In the following, the embodiment according to FIG. 2 will be discussed in detail. In this context, it should first be mentioned that parts which have the same function but are constructionally different have the same reference numbers but are provided with an apostrophe so that, to this extent, reference can be made to the preceding description. In the following, only selected constructional features of the embodiment according to FIG. 2 will be discussed in detail:

In the embodiment according to FIG. 2, the two pull rods 10' of a pair are arranged by means of their center lines in each case at the same height and in parallel to the area of the mold joints 5' assigned to the end-side impressions and at the same height as the piston rod 9 of the pertaining working cylinder 8'. However, in the embodiment according to FIG. 2, the tool-side linking of the pull rods 10' as well as the cylinder-side linking are achieved in a constructionally different manner. The two pull rods 10' extend with their tool-side end in each case into a holding wall 13 and are anchored with it in a form-locking manner against a pulling-out in corresponding recesses 35. The holding wall 13 is stationarily fastened on the stationary tool part 3' of the IHU-tool 1' and projects beyond the mold joint 5' of the stationary tool part in the direction of the liftable tool part 2' by at least half the diameter of the pull rods. Naturally, also in the case of the embodiment of FIG. 2, the tool-side embodiment of the releasable anchoring of the pull rods in the holding wall in the case of a plurality of different, alternately used IHU-tools, is constructed to be corresponding and exchangeable.

In the embodiment illustrated in FIG. 2, the holding wall 13 is arranged on the outer side of the stationary tool part 3' and surrounds it at a distance from the liftable tool part 2'. Both holding walls 13 for the two opposite pull rod pairs 10' are arranged in a closed, frame-type holding part 22 which surrounds and is rigidly connected with the stationary tool part 3'. It is also contemplated, instead of using such a frame-type holding part 22, to constructionally integrate the holding walls 13 in one piece with the stationary tool part 3'.

Instead, if the part of the IHU-tool 1' carrying the impression 4' offers sufficient space, it is also contemplated to arrange the holding wall 13 inside the circumferential contour of the mold joints 5' in the area of the end-side impression 6. However, in this case, a correspondingly large recess for the holding wall would have to be provided in the liftable took part 2'.

In the embodiment illustrated in FIG. 2, the holding plates 12' for the cylinder-side linking of the pull rods 10' are constructed in one piece. This requires that at least one of the two ends of the pull rods 10' is connected with tensile strength with the holding plate 12' either directly by means of a thread or by means of a bayonet-type turning locking device or that the tool-side head 11' or the cylinder-side head 19' is releasably connected with the shaft of the pull rod 10'. In FIG. 2, a head 19' is also provided on the cylinder-side end of the pull rods 10' which, however, is forged on and therefore can be constructed to be relatively small even in the case of a high tensile load. The larger head 11', which is mounted on the tool-side end of the pull rods 10', is fastened by means of a thread. In principle, the heads 11' are therefore large square nuts which are screwed onto an end-side thread on the pull rods.

For relieving the pull rods 10' from tensile loads because of the dead weight of the working cylinders 8', also in the embodiment illustrated in FIG. 2, the dead weight of the working cylinders 8' is supported by a swivellable and vertically changeable holding device. Specifically, in this case, the holding device is formed by a U-shaped supporting yoke 28 which is pivotally connected to the working cylinder 8' and which is pivotally connected to the swivel pin 27 of the working cylinder. The swivel pins project diametrically away from the circumference of the working cylinder 8' and are situated approximately in its center of gravity. In particular, the two swivel pins 27 are situated in the same axial plane as the two pull rods 10'. For the height adaptation of the working cylinders 8', the supporting yokes 28 can be supported by adapting pieces 29 and 29' of different heights. For the height adaptation of the stationary tool part 3' or of the holding part 22 for the holding walls 13, a support 32' is provided which in a suitable manner is selected from a set of adapting pieces of different heights.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A device for producing a hollow body according to an internal high pressure metal forming process comprising:

a tool which is divided along a mold joint into a stationary tool part and a liftable tool part, said tool having an impression for receiving a tube-shaped blank, an end-side impression being assigned to an end of the blank, respectively, and being arranged approximately parallel to and centrally with respect to an end-side portion of the mold joint;

a press which is movable in a direction transverse to the mold joint to open and close the tool;

an axially movable slide which is arranged concentrically with respect to the end-side impression, respectively, and which is sealingly attached to an open end of the blank, a pressure medium being introduced into the blank via at least one slide;

a hydraulic working cylinder which is arranged with a common axis as the end-side impression, respectively, and having a piston rod which holds the slide and which displaces the slide axially, the working cylinder being angularly and vertically adjustable on a support member; and a pair of pull rods which is assigned to the working cylinder, connecting the tool and the working cylinder with tensile strength in parallel to the common axis in order to receive a reaction force between the tool and the working cylinder, the pull rods of the pair being arranged on opposite sides of the piston rod at the same level as the piston rod, each pull rod extending into the end-side portion of the mold joint and being releasably anchored to each of the stationary tool part and the liftable tool part in a form-locking manner in corresponding recesses along the mold joint, said recesses configured such that after a working cycle the liftable tool part can be lifted away from the pull rod in a vertical direction without resistance.

2. A device according to claim 1, wherein the pull rod is anchored in the tool with a hammer head.

3. A device according to claim 1 wherein the pull rod is constructed for interconnection corresponding recesses of a plurality of tools, respectively, said plurality of tools requiring different angular positions of the working cylinder and pull rod with respect to the vertical direction, said different angular positions ranging from a smallest angle at which the angle between the pull rod and the vertical direction is the smallest, to a largest angle at which the angle between the pull rod and the vertical direction is the largest, the pull rod being anchored in the tool with a hammer head, which is configured such that a first surface of the hammer head which faces the liftable tool part extends perpendicular to the pull rod, and a second surface of the hammer head which faces the working cylinder extends in the vertical direction when the pull rod is positioned at said smallest angle with respect to the vertical direction, said second surface transmitting pressure to the liftable tool part when the pull rod is under a tensile load, the recess in the liftable tool part which receives the hammer head being constructed to correspond to said first surface and said second surface of the hammer head in order to receive the hammer head in a form-locking manner.

4. A device according to claim 1, wherein the pull rod is anchored on the working cylinder in a holding plate which is screwed to the working cylinder.

5. A device according to claim 1, wherein the working cylinder is arranged at a distance from one of a base plate supporting the tool and a press bed.

6. A device according to claim 1, wherein the support member comprises a U-shaped supporting yoke which is swivellably connected to the working cylinder and which is connected to an adapting piece which is used to adjust the working cylinder vertically.

7. A device according to claim 1, wherein the support member comprises a supporting roller which swivels in a roller joint.

8. A device according to claim 1, wherein the stationary tool part is supported by exchangeable adapting pieces to adjust the height of the tool.

9. A device according to claim 2, wherein the hammer head is releasably connected with the pull rod by means of a thread.

10. A device according to claim 2, wherein the hammer head is unreleasably connected with the pull rod and is integrated with the pull rod in a monolithic manner.

11. A device according to claim 3, wherein said second surface of the hammer head extends from the pull rod in a curve toward said first surface, the tangent of said curve at a point of intersection with said pull rod extending in the vertical direction.

12. A device according to claim 4, wherein the pull rod is anchored in the holding plate with a head respectively, which rests in a recess on a side of the holding plate toward the working cylinder, the pull rod penetrating through an opening in the holding plate toward the tool.

13. A device according to claim 4, wherein the pull rod is one of screwed into a thread of the holding plate and anchored in the holding plate with a bayonet-type turning locking device.

14. A device according to claim 4, wherein the holding plate is constructed in two parts, a parting joint of the holding plate extending diametrically through passage openings for the pair of pull rods and an interposed passage opening for the piston rod, opposite ends of each pull rod being anchored on the tool and on the working cylinder respectively with a head which is unreleasably fastened to the pull rod.

15. A device according to claim 4, wherein the holding plate is constructed in one piece and an end of each pull rod is anchored on the tool by one of a thread, a bayonet-type turning locking device, and a head which is detachably fastened on the pull rod.

16. A device according to claim 6, wherein the working cylinder is supported approximately below its center of gravity.

17. A device according to claim 6, wherein adapting pieces of different heights are provided to adjust the working cylinder vertically.

18. A device for producing a hollow body according to an internal high pressure metal forming process comprising:

a tool which is divided along a mold joint into a stationary tool part and a liftable tool part, said tool having an impression for receiving a tube-shaped blank, an end-side impression being assigned to an end of the blank, respectively, and being arranged approximately parallel to and centrally with respect to an end-side portion of the mold joint;

a press which is movable in a direction transverse to the mold joint to open and close the tool;

an axially movable slide which is arranged concentrically with respect to the end-side impression, respectively, and which is sealingly attached to an open end of the blank, a pressure medium being introduced into the blank via at least one slide;

a hydraulic working cylinder which is arranged with a common axis as the end-side impression, respectively, and having a piston rod which holds the slide and which displaces the slide axially, the working cylinder being angularly and vertically adjustable on a support member; and a pair of pull rods which is assigned to the working cylinder, connecting the tool and the working cylinder with tensile strength in parallel to the common axis in order to receive a reaction force between the tool and the working cylinder, the pull rods of the pair being arranged on opposite sides of the piston rod at the same level as the piston rod, each pull rod being releasably anchored to a holding wall in a form-locking manner in corresponding recesses, said holding wall being stationarily fastened to the stationary tool part and projecting beyond the mold joint in a direction toward the liftable tool part by at least half the diameter of the pull rod.

19. A device according to claim 18, wherein the holding wall is arranged on an outer side of the stationary tool part and surrounds the stationary tool part at least in an area of the end-side portion of the mold joint at a distance from the liftable tool part.

20. A device according to claim 18, wherein the holding wall for each respective pull rod pair is arranged in a closed frame which surrounds the stationary tool part and which is rigidly fastened to the stationary tool part.

21. A device according to claim 18, wherein the pull rod is anchored in the tool with a hammer head.

22. A device according to claim 18, wherein the pull rod is anchored on the working cylinder in a holding plate which is screwed to the working cylinder.

23. A device according to claim 18, wherein the working cylinder is arranged at a distance from one of a base plate supporting the tool and a press bed.

24. A device according to claim 18, wherein the support member comprises a U-shaped supporting yoke which is swivellably connected to the working cylinder and which is connected to an adapting piece which is used to adjust the working cylinder vertically.

25. A device according to claim 18, wherein the support member comprises a supporting roller which swivels in a roller joint.

26. A device according to claim 18, wherein the stationary tool part is supported by exchangeable adapting pieces to adjust the height of the tool.

27. A device according to claim 21, wherein the hammer head is releasably connected with the pull rod by means of a thread.

28. A device according to claim 21, wherein the hammer head is unreleasably connected with the pull rod and is integrated with the pull rod in a monolithic manner.

29. A device according to claim 22, wherein the pull rod is anchored in the holding plate with a head, which rests in a recess on a side of the holding plate toward the working cylinder, the pull rod penetrating through an opening in the holding plate toward the tool.

30. A device according to claim 22, wherein the pull rod is one of screwed into a thread of the holding plate and anchored in the holding plate with a bayonet-type turning locking device.

31. A device according to claim 22, wherein the holding plate is constructed in two parts, a parting joint of the holding plate extending diametrically through passage openings for the pair of pull rods and an interposed passage opening for the piston rod, opposite ends of each pull rod being anchored on the tool and on the working cylinder respectively with a head which is unreleasably fastened to the pull rod.

32. A device according to claim 22, wherein the holding plate is constructed in one piece and an end of each pull rod is anchored on the tool by one of a thread, a bayonet-type turning locking device, and a head which is detachably fastened on the pull rod.

33. A device according to claim 24, wherein the working cylinder is supported approximately below its center of gravity.

34. A device according to claim 24, wherein adapting pieces of different heights are provided to adjust the working cylinder vertically.

* * * * *